US009272860B2

(12) United States Patent
Maehara

(10) Patent No.: US 9,272,860 B2
(45) Date of Patent: Mar. 1, 2016

(54) SHEET FEEDING APPARATUS, IMAGE READING APPARATUS, AND IMAGE FORMING APPARATUS

(71) Applicant: CANON KABUSHIKI KAISHA, Tokyo (JP)

(72) Inventor: Kazuya Maehara, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/482,268

(22) Filed: Sep. 10, 2014

(65) Prior Publication Data

US 2015/0091244 A1 Apr. 2, 2015

(30) Foreign Application Priority Data

Sep. 27, 2013 (JP) ..... 2013-201297

(51) Int. Cl.
*B65H 3/06* (2006.01)

(52) U.S. Cl.
CPC ..... *B65H 3/0684* (2013.01); *B65H 3/0607* (2013.01); *B65H 3/0669* (2013.01); *B65H 2403/723* (2013.01); *B65H 2403/732* (2013.01)

(58) Field of Classification Search
CPC ..... B65H 3/0684; B65H 3/0669
See application file for complete search history.

(56) References Cited

U.S. PATENT DOCUMENTS

| | | | | |
|---|---|---|---|---|
| 5,720,477 | A * | 2/1998 | Morita et al. | 271/117 |
| 6,457,706 | B1 * | 10/2002 | Sheng et al. | 271/109 |
| 7,464,924 | B2 * | 12/2008 | Morimoto et al. | 271/118 |
| 2009/0134566 | A1 * | 5/2009 | Sumi | 271/109 |
| 2012/0161383 | A1 * | 6/2012 | Sato et al. | 271/10.13 |

FOREIGN PATENT DOCUMENTS

JP 2006-176290 A 7/2006

* cited by examiner

*Primary Examiner* — Luis A Gonzalez
(74) *Attorney, Agent, or Firm* — Fitzpatrick, Cella, Harper & Scinto

(57) ABSTRACT

A sheet feeding apparatus, in which a feeding roller can take a feeding and retracted positions through a simple configuration, and an image reading apparatus, and an image forming apparatus including the same. The sheet feeding apparatus includes an original stack tray, a pickup roller, a pickup arm, a separation shaft of a separation roller which is connected to the pickup roller and rotates the pickup arm, a driving motor which is connected to the shaft, and a weight member which is supported to the pickup arm on a side opposite to the pickup roller. When the driving motor is driven, the pickup arm is rotated to a feeding position to feed an original. When transmission of a driving to the shaft is blocked, the pickup roller is rotated to a retracted position by the weight member.

15 Claims, 13 Drawing Sheets

SHEET FEEDING APPARATUS, IMAGE READING APPARATUS, AND IMAGE FORMING APPARATUS

BACKGROUND OF THE INVENTION

1. Field of the Invention

The present invention relates to a sheet feeding apparatus, which feeds a sheet such as an original, and an image reading apparatus and an image forming apparatus including the same.

2. Description of the Related Art

In the past, there has been known an image reading apparatus including a so-called flow-readable original feeding apparatus (ADF) which automatically feeds an original to a predetermined image reading position and reads image information of the original by an optical system, which is disposed at the image reading position, when the original passes through the image reading position. In such an original feeding apparatus, a pickup roller feeds originals stacked in an original stack tray, and a separating unit separates the originals one by one and feeds the originals to a predetermined image reading position. Also, in order to inhibit an operator from setting an original and prevent conveyance failure upon two-sided reading, the pickup roller sets a position retracted upward as a home position, and the rotation of the pickup roller is performed by a pickup arm.

Herein, the pickup arm is rotated to a feeding position and a retracted position by a normal or reverse rotation of a driving unit. Therefore, for example, in order to rotate the pickup arm from the feeding position to the retracted position upon two-sided reading, it is necessary to provide a driving source different from a driving source which drives each conveying unit for reversing an original. Therefore, in the case of an original feeding apparatus capable of two-sided reading, two driving units are required, resulting in cost increase.

On the other hand, there is disclosed an original feeding apparatus in which when a spring member is engaged with a pickup arm and a driving of the pickup arm is interrupted, the pickup arm is rotated from a feeding position to a retracted position by a tension of the spring member (see Japanese Patent Laid-Open No. 2006-176290).

However, in the original feeding apparatus described in Japanese Patent Laid-Open No. 2006-176290, the spring member needs to be engaged with the pickup arm in a rotation area from the feeding position to the retracted position. Therefore, the action area of the spring member is long and the posture of the spring member is unstable, causing a variation in a tensile force. Therefore, it is apprehended that an original feeding force of an original feeding roller will be unstable. Also, an operation of hooking the spring member to the pickup arm occurs, and when assembling the pickup arm, the assembling is difficult.

Therefore, it is desirable to provide a sheet feeding apparatus in which a feeding roller can take a feeding position and a retracted position through a simple configuration, and an image reading apparatus and an image forming apparatus including the same.

SUMMARY OF THE INVENTION

According to the present invention, a sheet feeding apparatus includes: a sheet stacking portion in which a sheet is stacked; a feeding roller which feeds the sheet stacked in the sheet stacking portion; a pickup arm which supports the feeding roller such that the feeding roller is movable between a feeding position abutting against the sheet stacked in the sheet stacking portion and a retracted position spaced apart from the feeding position; a driving rotational shaft which is connected to the feeding roller and rotates the pickup arm; a driving portion which drives the driving rotational shaft; and a weight member which is supported to the pickup arm on a side opposite to the feeding roller with respect to the driving rotational shaft, wherein when the driving rotational shaft is driven by the driving portion, the pickup arm is rotated and the feeding roller feeds the sheet at the feeding position, and when a driving from the driving portion to the driving rotational shaft is stopped, the pickup arm is rotated by the weight member and the feeding roller is moved to the retracted position.

According to the present invention, it is possible to provide a sheet feeding apparatus, in which a feeding roller can take a feeding position and a retracted position through a simple configuration, and an image reading apparatus and an image forming apparatus including the same.

Further features of the present invention will become apparent from the following description of exemplary embodiments with reference to the attached drawings.

DESCRIPTION OF THE EMBODIMENTS

Hereinafter, an image forming apparatus according to an embodiment of the present invention will be described with reference to the drawings. The image forming apparatus according to the present embodiment is an image forming apparatus including an image reading apparatus with a sheet feeding apparatus which can feed an original to an image reading portion, such as a copying machine, a printer, a facsimile machine, and a multifunctional machine thereof. In the following embodiment, as the image forming apparatus, a laser beam printer of an electrophotographic system (hereinafter, referred to as "printer") 100 will be described.

First Embodiment

Figure 1:
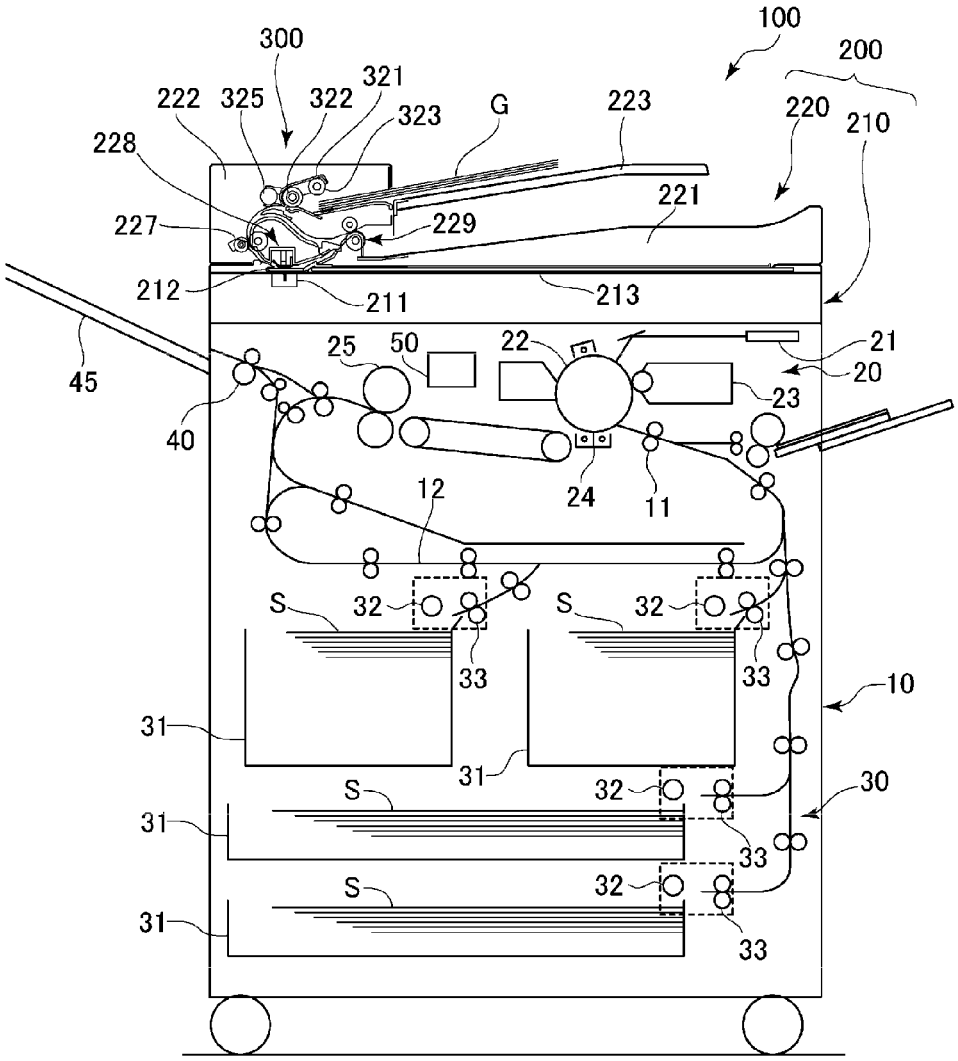
FIG. 1 is a cross-sectional view schematically illustrating a printer according to a first embodiment of the present invention.
Figure 2:
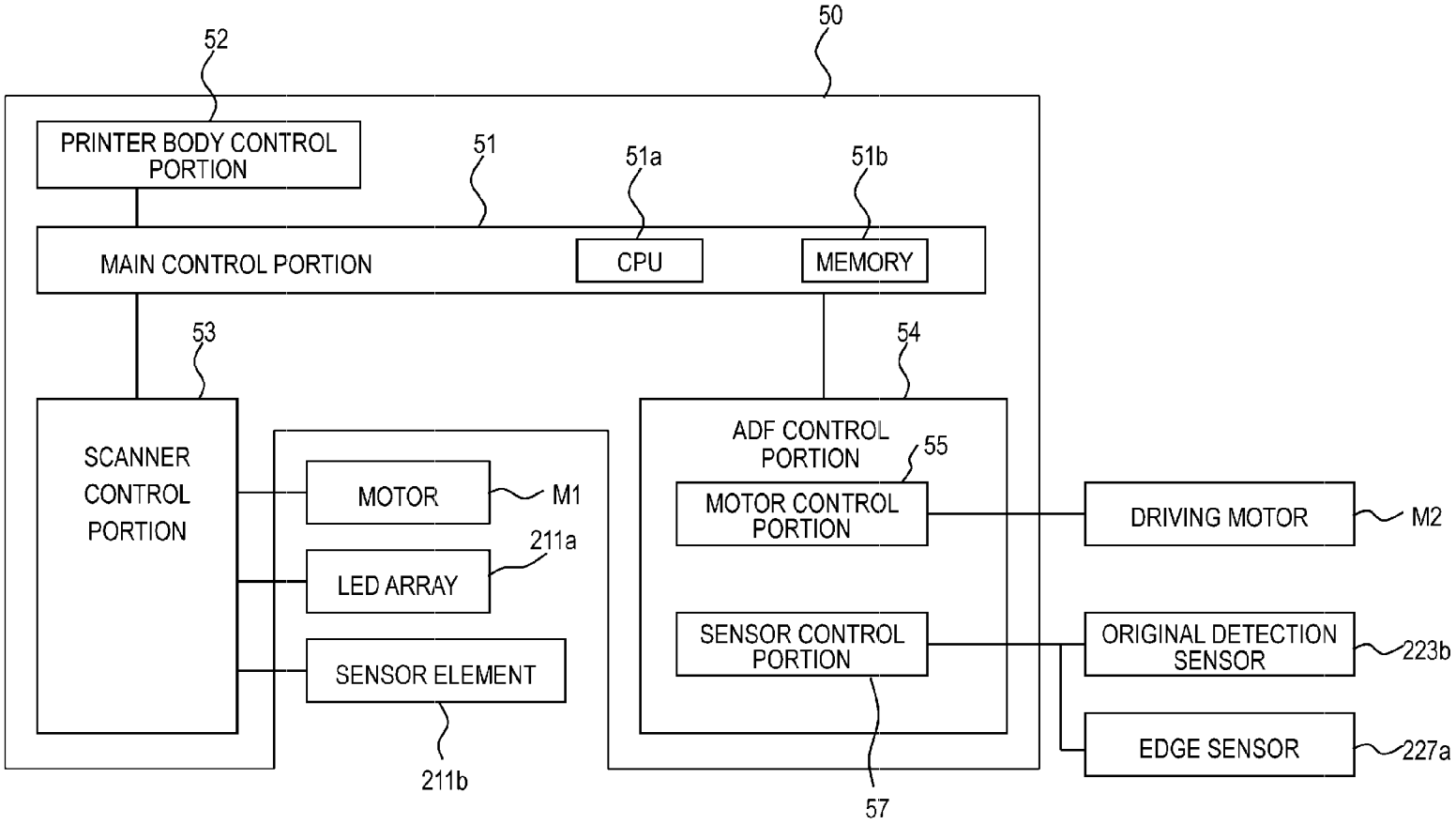
FIG. 2 is a block diagram illustrating a configuration of a controller of the printer according to the first embodiment.

A printer 100 according to a first embodiment will be described with reference to FIGS. 1 to 10. Also, a schematic configuration of the printer 100 will be described with reference to FIGS. 1 and 2. FIG. 1 is a cross-sectional view schematically illustrating the printer 100 according to the embodiment of the present invention. FIG. 2 is block diagram illustrating a configuration of a controller of the printer 100 according to the present embodiment. Incidentally, in the following, a position facing an operation portion (not illustrated) which allows a user to perform various inputs/settings to the printer 100 is referred to as a "front side" of the printer 100, and a back side thereof is referred to as a "rear side". That is, FIG. 1 illustrates the internal configuration of the printer 100 when viewed from a front side.

As illustrated in FIG. 1, the printer 100 includes an image reading apparatus 200 which can read an image of an original (a sheet) G, a printer body 10 which can form the image read by the image reading apparatus 200 on a sheet S, and a controller 50 which controls the image reading apparatus 200 and the printer body 10.

The image reading apparatus 200 includes a scanner portion 210 which reads the image of the original G, and an original feeding portion (sheet feeding apparatus) 220 which can feed the original G to the scanner portion 210. Also, the scanner portion 210 and the original feeding portion 220 will be described below in detail.

The printer body 10 includes an image forming portion 20 which forms an image on the sheet S, a sheet feeding portion 30 which feeds the sheet S to the image forming portion 20, a discharging portion 40 which discharges the sheet S, on which the image is formed, to the outside of the apparatus, and a discharged sheet stacking portion 45 in which the discharged sheet S is stacked. The image forming portion 20 includes a laser scanner unit 21 which irradiates a laser beam, a photosensitive drum 22 on which a toner image is formed, a developing portion 23, a transferring portion 24 which transfers the toner image, and a fixing portion 25 which fixes the toner image. The sheet feeding portion 30 includes a sheet cassette 31 in which the sheet S is stacked, a feeding roller 32 which feeds the sheet S, and a separating unit 33 which separates the sheet S one by one. The discharging portion 40 includes a pair of discharge rollers. The discharged sheet stacking portion 45 includes a discharged sheet stack tray.

As illustrated in FIG. 2, the controller 50 includes a main control portion 51. The main control portion 51 includes a CPU 51*a* which performs driving control on a printer body control portion 52 which controls the image forming portion 20 or the like, a scanner control portion 53 which controls the scanner portion 210, and an ADF control portion 54 which controls the original feeding portion 220. The ADF control portion 54 includes a motor control portion 55 and a sensor control portion 57. Also, the main control portion 51 includes a memory 51*b* which stores a variety of programs or a variety of information when the CPU 51*a* performs an image forming operation or an image reading operation. That is, due to the main control portion 51, the operations of the printer body 10, the scanner portion 210, and the original feeding portion 220 are integrated, and the feeding of the original G or the reading of the image, and the forming of the image on the sheet S are performed.

Next, the image forming operation of the printer 100 (image forming control by the controller 50) will be described. Also, the image forming operation of forming the image on the sheet S based on the image information of the original G automatically fed by the original feeding portion 220 and read by the scanner portion 210 will be described. Also, the image reading operation of the image reading apparatus 200 (image reading control by the controller 50) will be described below in detail.

When the image information of the original G fed from the original feeding portion 220 and read by the scanner portion 210 is input, a laser beam is irradiated from the laser scanner unit 21 to the photosensitive drum 22, based on the input image information. At this time, the photosensitive drum 22 is previously charged and an electrostatic latent image is formed thereon by the irradiation of the laser beam. After that, the electrostatic latent image is developed by the developing portion 23 to form a toner image on the photosensitive drum 22.

In parallel to the operation of forming the toner image on the photosensitive drum 22, the sheet S accommodated in the sheet cassette 31 of the sheet feeding portion 30 is fed by the feeding roller 32. The sheet S fed by the feeding roller 32 is separated one by one by the separating unit 33. The sheet S separated one by one is fed to the transferring portion 24 in synchronization with the toner image on the photosensitive drum 22 by a registration roller 11. On the sheet S fed to the transferring portion 24, the toner image on the photosensitive drum 22 is transferred by the transferring portion 24.

On the sheet S on which the toner image is transferred, a heated and pressurized toner image is fixed by the fixing portion 25. The sheet S, on which the toner image is fixed, is discharged to the discharged sheet stacking portion (discharged sheet stack tray) 45 by the discharging portion (pair of discharge rollers) 40 and is sequentially stacked. Incidentally, in a case where an image is formed on both sides of the sheet S, after an image is fixed on a first side of the sheet S, the sheet S is re-conveyed to the registration roller 11 through a reverse conveyance path 12, and the above-described operations are repeated.

Figure 3:
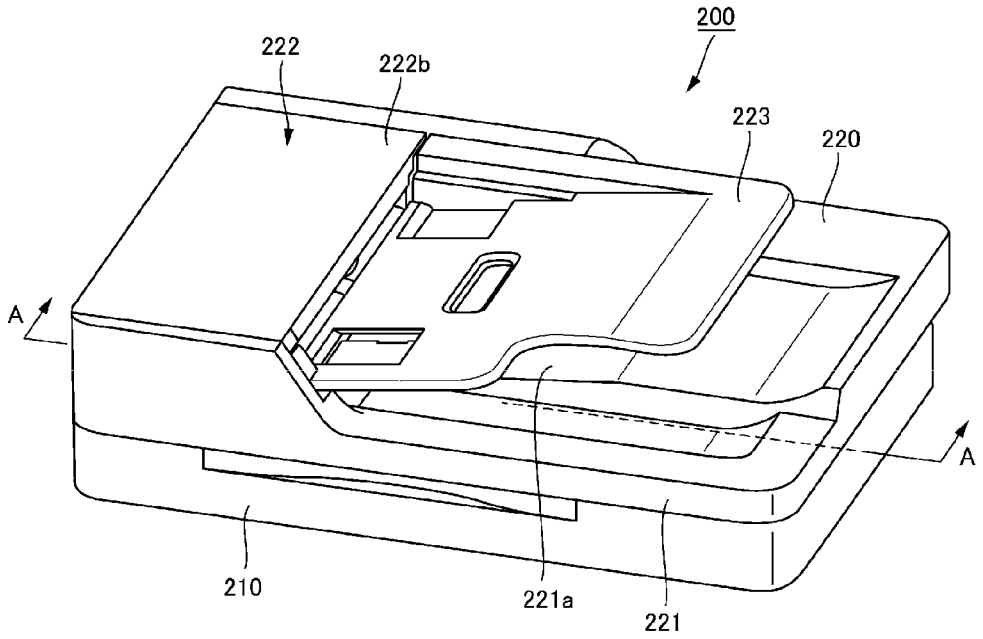
FIG. 3 is a perspective view of an image reading apparatus according to the first embodiment.
Figure 4:
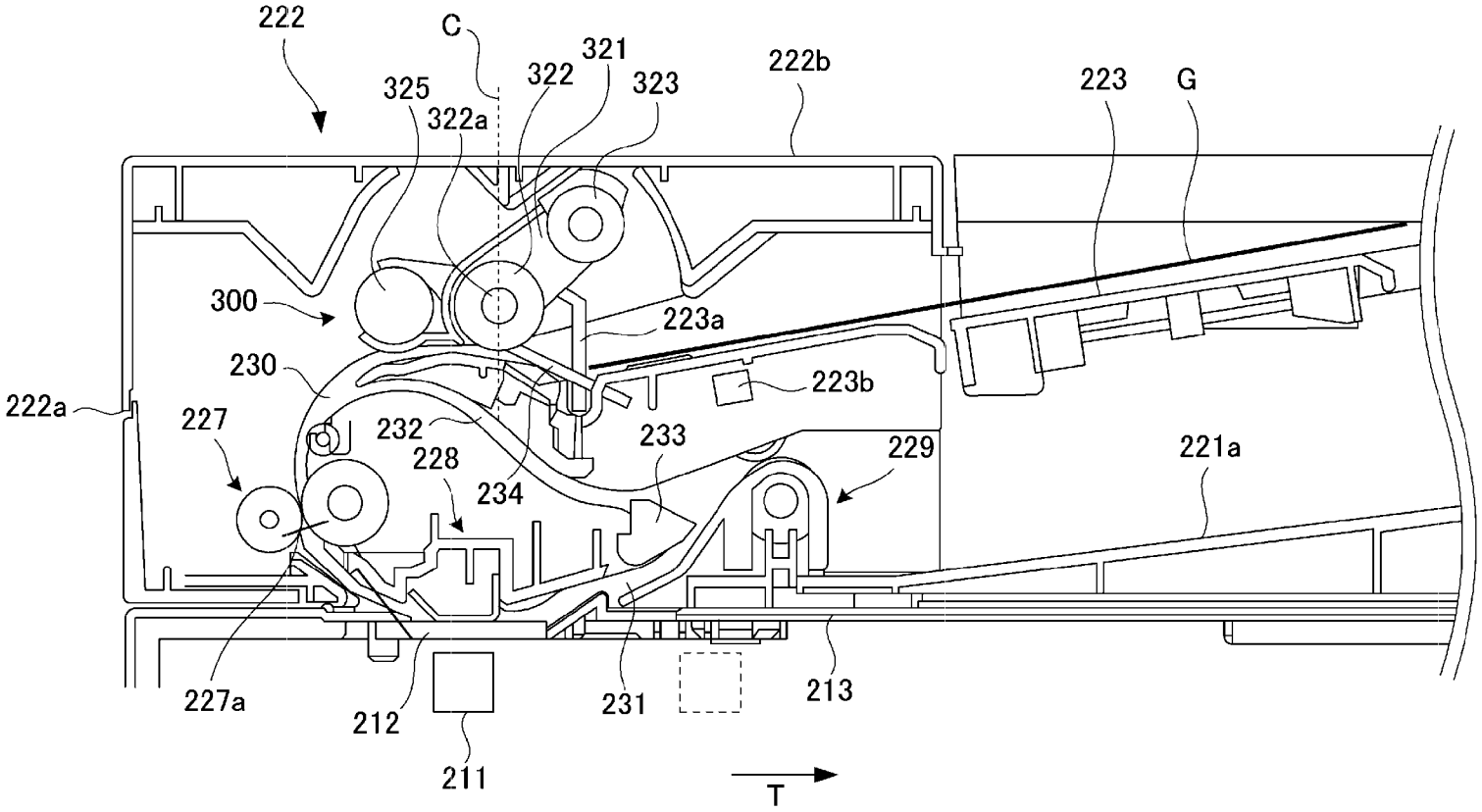
FIG. 4 is a cross-sectional view taken along an arrow A-A of the image reading apparatus illustrated in FIG. 3.

Next, the above-described image reading apparatus 200 will be described with reference to FIGS. 3 to 10. Also, a schematic configuration of the image reading apparatus 200 will be described with reference to FIGS. 3 and 4. FIG. 3 is a perspective view of the image reading apparatus 200 according to a first embodiment. FIG. 4 is a cross-sectional view taken along an arrow A-A of the image reading apparatus 200 illustrated in FIG. 3.

As described above, the image reading apparatus 200 includes a scanner portion 210 and an original feeding portion 220. Also, in the image reading apparatus 200, the original feeding portion 220 is rotatably supported to the scanner portion 210 by a hinge disposed on the rear side, such that an original base plate glass 213 to be described below can be opened or closed from the front side. Hereinafter, the scanner portion 210 and the original feeding portion 220 will be described below in detail.

As illustrated in FIGS. 3 and 4, the scanner portion 210 includes a scanner unit (image reading portion) 211 which reads the image of the original G, a platen glass 212, and an original base plate glass 213 disposed in parallel to the platen glass 212 in a sub-scanning direction. In the scanner unit 211 according to the present embodiment, a contact image sensor (CIS) of an equal magnification optical system is used. Incidentally, the CIS irradiates light on an image information surface of the original G from an LED array 211*a* (see FIG. 2) as a light source, and reads image information by imaging reflected light reflected from the image information surface on a sensor element 211*b* (see FIG. 2).

The scanner unit 211 is connected to a driving belt (not illustrated) and is movable to a solid-line position (below the platen glass 212) illustrated in FIG. 4 and a dashed-line position (below the original base plate glass 213) illustrated in FIG. 4 by a driving of a motor M1 (see FIG. 2). Also, the position of the scanner unit 211 can be grasped by a position sensor (not illustrated) and the number of rotation pulses of the motor M1. Also, the type of reading by stopping the scanner unit 211 at the solid-line position and moving the original G above the platen glass 212 by the original feeding portion 220 is referred to as flow-reading. Also, the type of reading by placing the original G on the original base plate glass 213 and moving the scanner unit 211 from the dashed-line position in a direction of an arrow T in FIG. 4 by the motor M1 is referred to as fixed-reading.

The original feeding portion 220 includes an original base plate cover 221 rotatably supported to the scanner portion 210, and an automatic feeding device (ADF) 222 which automatically feeds the original G to a predetermined image reading position (above the platen glass 212) upon flow-reading.

The original base plate cover 221 is supported to the scanner portion 210 so as to open or close the platen glass 212 and the original base plate glass 213, and is formed to press the original G such that the original G stacked in the original base plate glass 213 is moved upon fixed-reading. Also, on the top surface of the original base plate cover 221, an original stacking portion 221*a* is provided such that the original G discharged to the outside of the apparatus after the flow-reading is stacked.

The automatic feeding device 222 includes an original stack tray 223 which stacks the original G, a separating/feeding unit 300 which separates and feeds the original G stacked in the original stack tray 223, and a pair of original conveying rollers 227 which aligns the front edge of the original G and conveys the original G to an image reading position. Also, the automatic feeding device 222 includes a guide unit 228 which guides the original G at the image reading position, and a pair of discharge rollers 229 which discharges the original G, the image of which is read, to the outside of the apparatus.

The original stack tray 223 includes a width-direction restricting plate (not illustrated) capable of sliding in a width direction of the original G. The width-direction restriction plate restricts the width direction of the original G stacked in the original stack tray 223, thereby securing stability upon the feeding of the original G. Also, the original stack tray 223 includes an original stopper 223*a* which abuts against the stacked original G and inhibits the entry of the original G into an original feeding path 230, and an original detection sensor 223*b* which detects the presence or absence of the original G. Also, the original feeding path 230 can be opened by rotating the upper cover 222*b* which is rotatable around the rotational shaft 222*a*. Therefore, for example, in a case where the original G is jammed, it is possible to easily remove the jammed original.

The separating/feeding unit 300 is provided downstream in the original feeding direction of the original stack tray 223 and sets the position illustrated in FIG. 4 as the home position so as not to inhibit the operator from performing the operation of setting the original G. Incidentally, the separating/feeding unit 300 will be described below in detail.

The pair of original conveying rollers 227 is provided downstream in the original feeding direction of the separating/feeding unit 300 and conveys the original G toward the image reading position above the platen glass 212 while aligning the front edge of the original G. An edge sensor 227*a* is provided downstream in the original conveying direction of the pair of original conveying rollers 227 so as to detect the passage of the front end or the rear end of the original G. The guide unit 228 guides the original G such that the original G conveyed by the pair of original conveying rollers 227 is stably moved above the platen glass 212. The pair of discharge rollers 229 is provided downstream of an original discharge path 231 and is configured to be normally/reversely rotatable. The pair of discharge rollers 229 is normally rotated to convey the original G to the outside of the apparatus and is reversely rotated to convey the original G to the reverse conveyance path 232. Also, a switching member 233 is provided at the branch of the original discharge path 231 and the reverse conveyance path 232. The switching member 233 switches the conveyance path of the original G.

Figure 5:
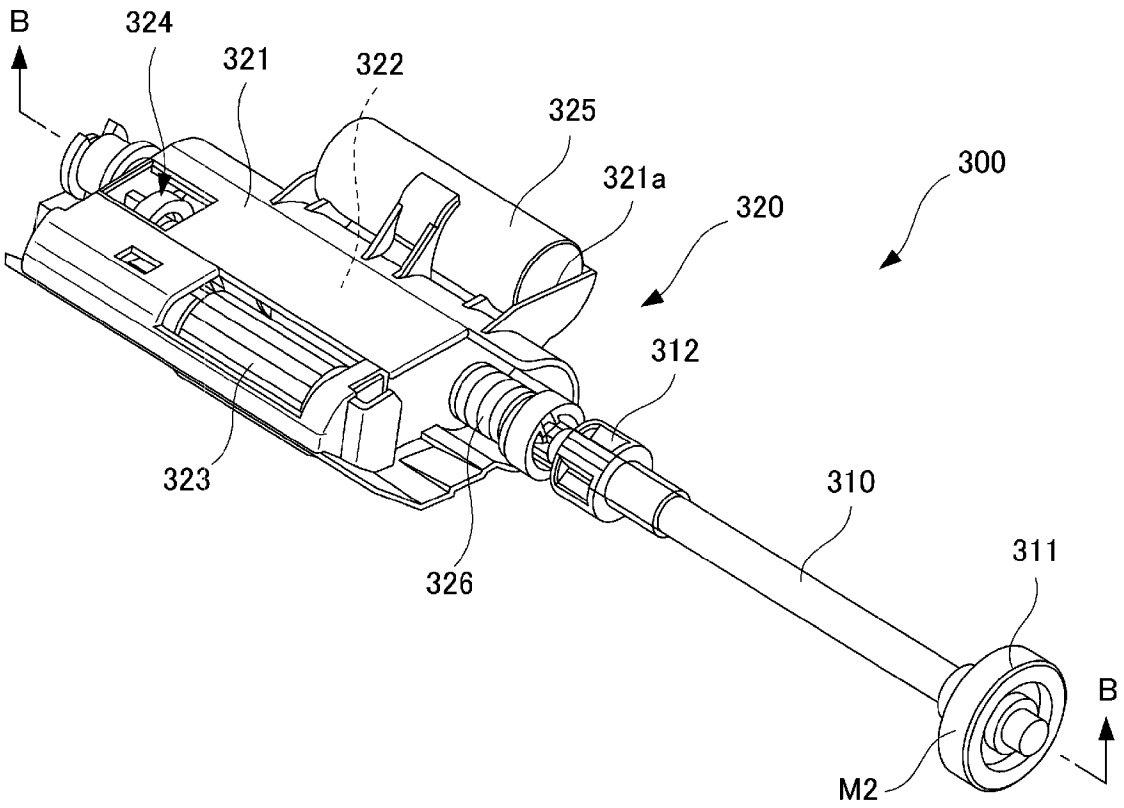
FIG. 5 is a perspective view illustrating a separating/feeding unit.
Figure 6:
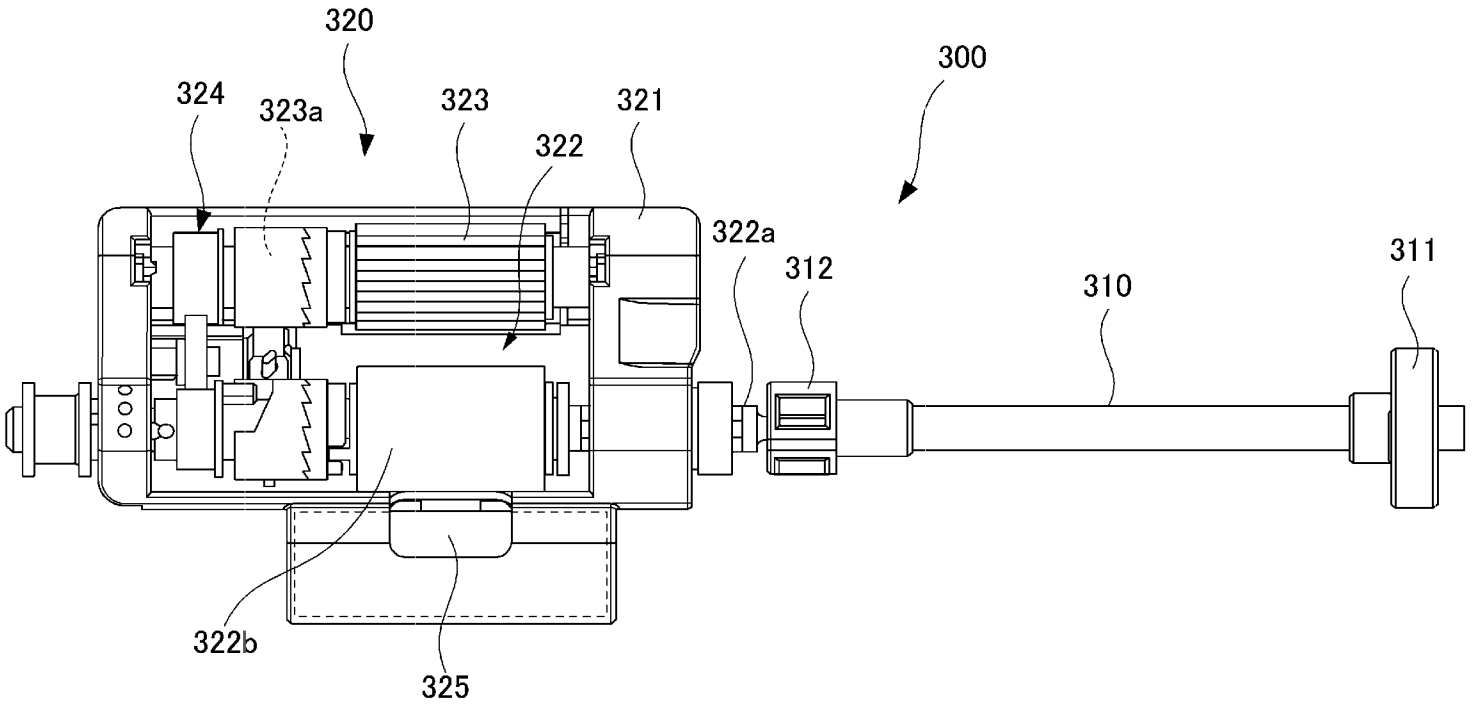
FIG. 6 is a cross-sectional view taken along an arrow B-B of the separating/feeding unit illustrated in FIG. 5.
Figure 7:
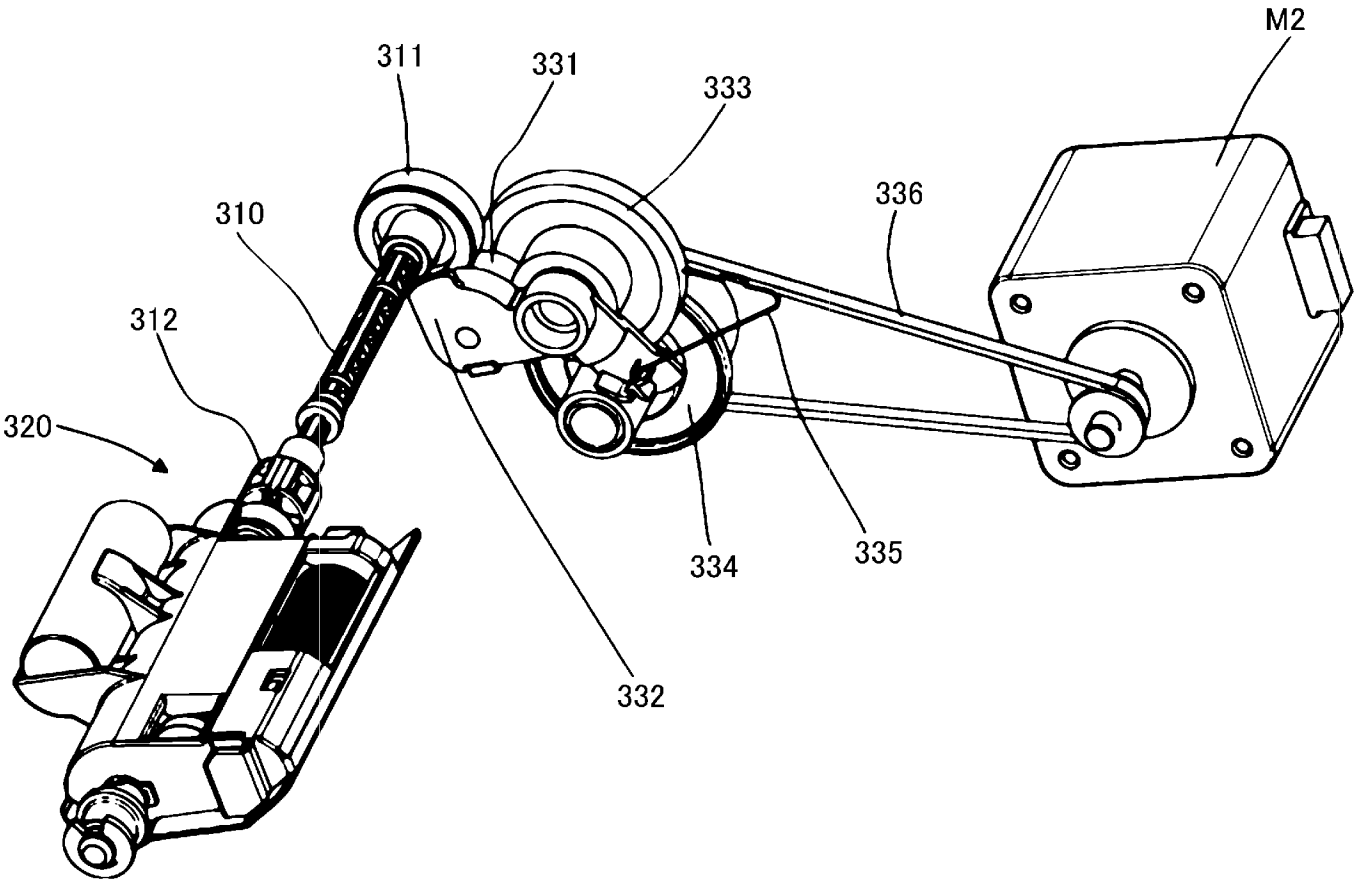
FIG. 7 is a perspective view illustrating a driving of the separating/feeding unit.
Figure 8A:
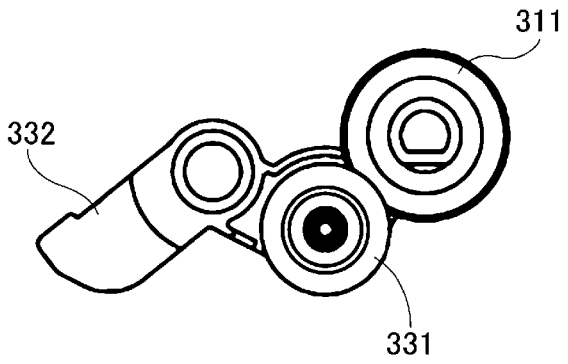
FIGS. 8A and 8B are views illustrating a contact/separation state of the separating/feeding unit and a driving portion illustrated in FIG. 7.
Figure 8B:
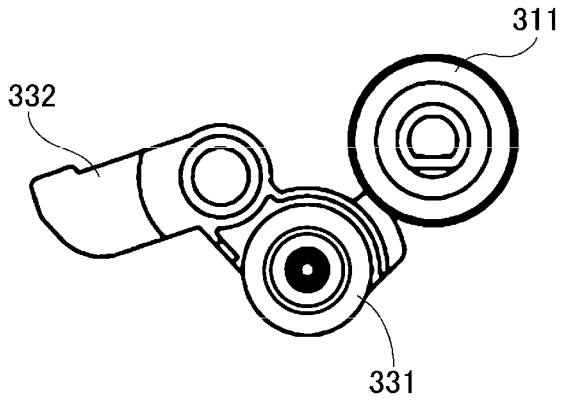

Next, the above-described separating/feeding unit 300 will be described with reference to FIGS. 5 to 9. Also, a schematic configuration of the separating/feeding unit 300 will be described with reference to FIGS. 5 to 8. FIG. 5 is a perspective view illustrating the separating/feeding unit 300. FIG. 6 is a cross-sectional view taken along an arrow B-B of the separating/feeding unit 300 illustrated in FIG. 5. FIG. 7 is a perspective view illustrating the driving of the separating/feeding unit 300. FIGS. 8A and 8B are views illustrating a contact/separation state of the separating/feeding unit 300 and a driving portion. Specifically, FIG. 8A illustrates a contact state and FIG. 8B illustrates a separation state.

As illustrated in FIGS. 5 to 7, the separating/feeding unit 300 includes a connection shaft 310 which is connected to a driving motor (driving portion) M2, and a unit body 320 which is connected to the connection shaft 310. The connection shaft 310 is rotatably supported to the upper cover 222*b* and is connected to the driving motor M2 through a pendulum gear 331, one end of which is rotatably supported to a separation driving gear 311 and a pendulum arm 332, driving arms 333 and 334, and a driving belt 336. Also, a coupling ring 312 is provided at the other end of the connection shaft 310 so as to connect the unit body 320.

The unit body 320 includes a pickup arm 321, and a separation roller 322 which is rotatably supported to the pickup arm 321 and is detachably connected to the coupling ring 312. Also, the unit body 320 includes a pickup roller (feeding roller) 323 which is rotatably supported to the pickup arm 321, and a gear train (transmission unit) 324 which connects the separation roller 322 and the pickup roller 323. Furthermore, the unit body 320 includes a weight member 325 which is attached to the pickup arm 321.

The pickup arm 321 is connected to the separation shaft (driving rotational shaft) 322*a* of the separation roller 322 through a spring clutch (driving transmission unit) 326. When a predetermined torque is applied to the pickup arm 321, the spring clutch 326 idles to block the driving transmission from the separation shaft 322*a*. That is, the pickup arm 321 rotates around the separation shaft 322*a* while interlocking with the rotation of the connection shaft 310. When the pickup roller 323 abuts against the original G and thus receives a reaction force from the original G, the pickup roller 323 stops rotating. Also, the driving transmission unit which connects the driving to the pickup arm 321 or disconnects the driving from the pickup arm 321 is not limited to the spring clutch 326. For example, when the pickup arm 321 rotates and the pickup roller 323 abuts against the original G, the pickup arm 321 is folded. When the folding of the pickup arm 321 is detected, the driving transmission from the separation shaft may be blocked.

When a roller body 322*b* is fixed to the separation shaft 322*a* so as to be pressed against a separation pad 234 and rotates while interlocking with the connection shaft 310, the separation roller 322 separates the original G one by one and feeds the original which enters a nip with respect to the separation pad 234. The pickup roller 323 is rotatably supported to the front edge of the pickup arm 321 and rotates around a feeding shaft 323*a* to feed the original G stacked in the original stack tray 223.

The gear train 324 transmits the torque of the separation roller 322 to the pickup roller 323 by connecting the separation shaft 322*a* and the feeding shaft 323*a*. That is, the gear train 324 rotates the separation roller 322 and the pickup roller 323 together. Also, the separation shaft 322*a* and the feeding shaft 323*a* may be drive-connected by a connection unit such as a connection belt, in addition to the gear train.

The weight member 325 is provided on a side opposite to the pickup roller 323 with respect to the separation shaft 322*a* and is set to have a moment greater than a moment caused by a self-weight around the separation shaft 322*a* which is applied to the pickup roller 323. Herein, on the opposite side with respect to the separation shaft 322*a*, when a perpendicular line C is drawn to pass through the separation shaft 322*a*, the weight member 325 and the pickup roller 323 indicate a state of being on the opposite sides with respect to the perpendicular line C (see FIG. 4). Also, as a method of increasing the moment, a method of arranging the weight member 325 at a position spaced apart from the separation shaft 322*a* may be considered in addition to a method of increasing a weight of the weight member 325 may be considered. However, if considering an increase in size, it is suitable to adjust the weight of the weight member 325. Also, the weight member 325 is disposed in a holder portion 321*a* of the pickup arm 321, and the holder portion 321*a* is configured to easily remove the weight member 325.

Figure 9A:
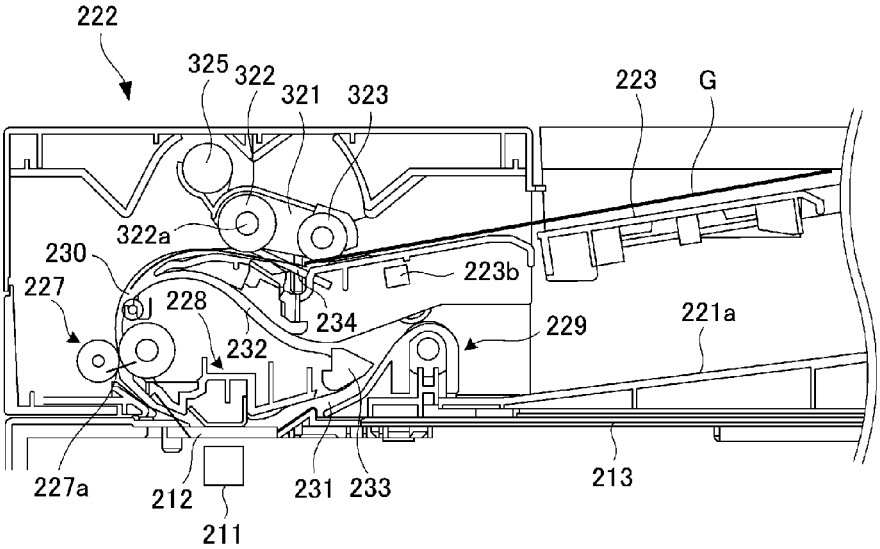
FIGS. 9A and 9B are cross-sectional views illustrating a swing operation of the separating/feeding unit according to the first embodiment.
Figure 9B:
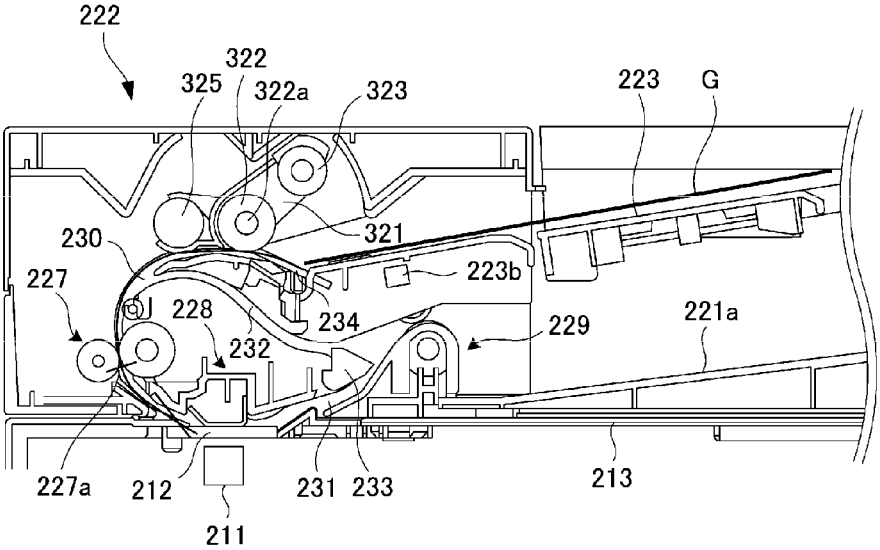
Figure 10:
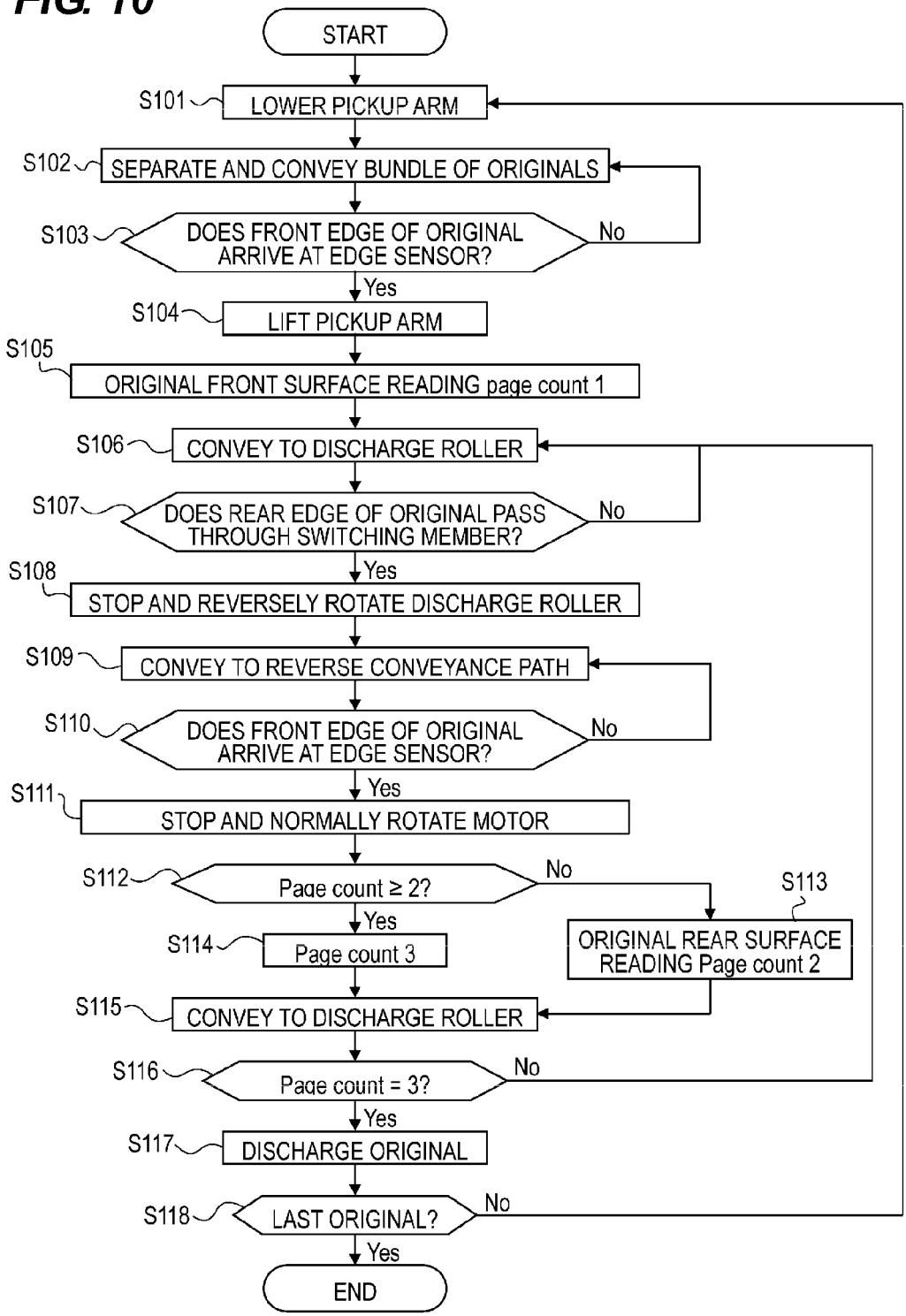
FIG. 10 is a flowchart of an image reading operation by an image reading apparatus.

Next, the swing operation of the separating/feeding unit 300 will be described along with the two-sided image reading operation by the image reading apparatus 200, with reference to FIGS. 8 to 10 as well as FIG. 4. FIGS. 8A and 8B are views illustrating a contact/separation state of the separating/feeding unit and the driving portion illustrated in FIG. 7. FIGS. 9A and 9B are cross-sectional views illustrating the swing operation of the separating/feeding unit 300 according to the first embodiment. FIG. 10 is a flowchart of the image reading operation by the image reading apparatus 200. Incidentally, FIG. 10 is a flowchart of a case of reading the two sides of the sheet.

As illustrated in FIG. 4, the pickup arm 321 is located at a retracted position so as to receive the original G up to a position (original feeding position) where the front edge of the original G stacked in the original stack tray 223 collides with the original stopper 223*a*. In this case, the pickup arm 321 waits at the retracted position by the weight of the weight member 325. In this case, when the original G is set, the entry of the original G into the original feeding path 230 is restricted at the original feeding position by the original stopper 223*a*, and the presence or absence of the original G is detected by the original detection sensor 223*b*.

Next, when the user instructs to start reading the original G from an operation portion (not illustrated), the driving motor M2 is driven and the pickup arm 321 starts rotating around the separation shaft 322*a* against the weight member 325 in a clockwise direction in FIG. 4 (step S101). Also, a torque which rotates the pickup arm 321 by the driving motor M2 is set to be greater than the gravity of the weight member 325. Also, when the driving motor M2 is driven, the separation roller 322 and the pickup roller 323 are also rotated.

When the pickup arm 321 is rotated clockwise, the pickup roller 323 starts to be moved (lowered) from the retracted position illustrated in FIG. 4 toward the feeding position illustrated in FIG. 9A. Also, when the pickup arm 321 is rotated clockwise, the original stopper 223*a* is pressed down by the pickup arm 321.

After that, when the pickup roller 323 abuts against the top original G stacked in the original stack tray 223, the pickup arm 321 receives a predetermined reaction force from the original G with respect to the lowering direction. When the pickup arm 321 receives the predetermined reaction force, the spring clutch 326 has transmitted the torque in the lowering direction starts idling due to a friction force occurring between the spring clutch 326 and the pickup arm 321. Therefore, the lowering of the pickup arm 321 is stopped in a state in which the pickup roller 323 abuts against the original G, and the feeding of the original G is started by the pickup roller 323 (step S102).

The original G fed by the pickup roller 323 passes over the original stopper 223*a* and is separated one by one by the separation roller 322 and the separation pad 234, and only the top original G is fed to the original feeding path 230. The original G fed to the original feeding path 230 is conveyed toward the image reading position by the pair of original conveying rollers 227. When the edge sensor 227*a* detects the front edge of the original G (step S103), image information of a first surface (front surface) of the original G starts to be read by the scanner unit 211 at a position conveyed by a predetermined amount from the detection position. Also, at the position conveyed by the predetermined amount from the detection position, the pendulum gear 331 is separated from the separation driving gear 311 by reversely rotating the driving motor M2 and the driving transmission is blocked, as illustrated in FIG. 8B. Also, the pair of original conveying rollers 227 is configured to rotate in only the original conveying direction. The pair of original conveying rollers 227 is not always reversely rotated when the driving motor M2 is reversely rotated.

When the driving transmission of the driving motor M2 and the separation driving gear 311 is blocked, the torque transmitted in the lowering direction of the pickup arm 321 is eliminated. Therefore, the pickup arm 321 starts to be rotated (lifted) toward the retracted position illustrated in FIG. 9B by the moment around the separation shaft 322*a* caused by the self-weight of the weight member 325 (step S104). When the pickup arm 321 is lifted, the pickup roller 323 is separated from the original G and the feeding of the original G is stopped. When the driving motor M2 is normally rotated again, the pendulum stopper 335 is caught by a projection portion of the pendulum arm 332, and a separated state of the pendulum gear 331 and the separation driving gear 311 is continued. Therefore, the pickup arm 321 does not abut against the original G by being lowered during the conveying of the original G after that.

When image information of the first surface (front surface) of the original G is read at the image reading position, a page count 1 is input and the original G is scooped up by a jump ramp and the original G is conveyed toward the pair of discharge rollers 229 in the original discharge path 231 (steps S105 and S106). Also, a page count is a flag which controls the reading operation. The pair of discharge rollers 229 conveys the original G to the outside of the apparatus. When the rear edge of the original G passes through the switching member 233, the pair of discharge rollers 229 is paused and then is reversely rotated to convey the original G toward the reverse conveyance path 232 (steps S107 to S109). At this time, the conveyance path of the original G is switched to the reverse conveyance path 232 by the switching member 233, and the original G is fed to the reverse conveyance path 232 by the reverse rotation of the pair of discharge rollers 229. The original G fed to the reverse conveyance path 232 is conveyed again to the image reading position. When image information of a second surface (rear surface) of the original G is read at the image reading position, a page count 2 is input. In the same manner as described above, the original G is conveyed toward the pair of discharge rollers 229 in the original discharge path 231 (steps S110 to S115).

The original G conveyed to the pair of discharge rollers 229 is conveyed again to the reverse conveyance path 232 by the pair of discharge rollers 229 and the switching member 233. The value is changed from the page count 2 to the page count 3, and the original G is discharged to the outside of the apparatus without reading the image information (steps S116 and S117). The original G discharged to the outside of the apparatus is moved along the inclined original stacking portion 221*a* and is accommodated in a state in which the rear edge of the original G is held on an original holding surface. These are repeated until the original detection sensor 223*b* detects the absence of the original (step S118).

As described above, the printer according to the present embodiment moves the pickup roller 323 from the feeding position to the retracted position by rotating the pickup arm 321 by using the weight member 325. Therefore, as compared with the case of rotating the pickup arm by using the spring member as in the past, the feeding roller can move the feeding position and the retracted position through a simple configuration. For example, even when the rotating amount of the pickup arm 321 is increased so as to increase the stacking amount of the original G of the original stack tray 223, there occurs no problem that the tensile force of the spring member is varied. Also, it is possible to prevent the original feeding force from becoming unstable due to the pickup roller 323 resulting from the variation of the tensile force.

Also, the weight member 325 is provided in the holder portion 321*a* of the pickup arm 321. Therefore, the pickup arm 321 is easily assembled, and the upper cover 222*b* of the pickup arm 321 is also easily assembled.

Also, in the present embodiment, the pickup roller 323 which separates and feeds the original G is provided with a unit as the separating/feeding unit 300, and the separating/feeding unit 300 is detachably attached to the upper cover 222*b*. Therefore, the maintenance or replacement is facilitated. Also, since the alignment is also facilitated, it is possible to prevent the operator from performing wrong attachment. Furthermore, even after the assembling, the original G can be stably fed.

Second Embodiment

A printer according to a second embodiment of the present invention will be described with reference to FIGS. 11 to 13. The printer according to the second embodiment differs from the first embodiment in that a biasing spring (biasing member) 327 is provided to bias the weight member 325 of the separating/feeding unit 300. Therefore, herein, the description will focus on the biasing spring 327. The same reference numerals as those of the first embodiment are assigned to the remaining configuration, and a description thereof will be omitted.

First, a schematic configuration of the biasing spring 327 will be described with reference to FIG. 11. FIG. 11 is a partial cross-sectional view of an image reading apparatus 200A according to a second embodiment.

Figure 11:
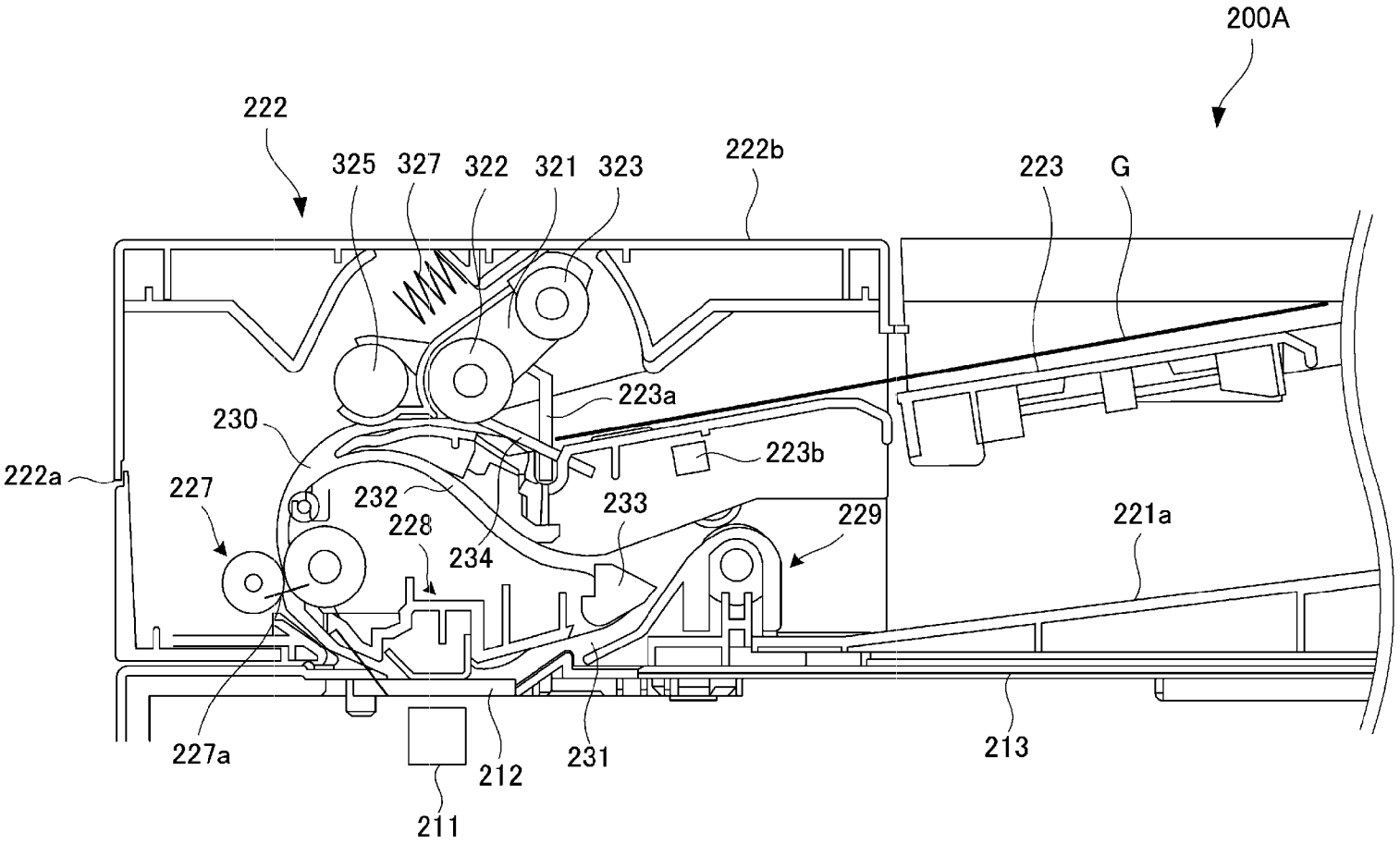
FIG. 11 is a partial cross-sectional view of an image reading apparatus according to a second embodiment.

As illustrated in FIG. 11, the biasing spring 327 is attached to the upper cover 222*b*. When the pickup arm 321 is located at the retracted position, the biasing spring 327 is separated from the weight member 325. When the pickup arm 321 is rotated by a predetermined amount from the retracted position toward the feeding position, the biasing spring 327 abuts against the weight member 325. Also, a natural length or an attaching angle is set such that a predetermined pressing force is obtained by compressing the biasing spring 327 by the weight member 325 at the feeding position.

Next, the swing operation of the separating/feeding unit 300 according to the second embodiment will be described with reference to FIG. 12. FIGS. 12A to 12C are cross-sectional views illustrating the swing operation of the separating/feeding unit 300 according to the second embodiment. Specifically, FIGS. 12A, 12B, and 12C illustrate the separating/feeding unit 300 located at the retracted position, the middle position, and the feeding position, respectively.

Figure 12A:
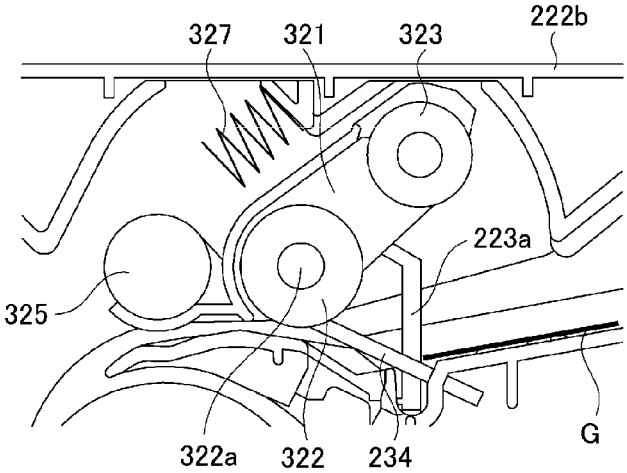
FIGS. 12A to 12C are cross-sectional views illustrating a swing operation of a separating/feeding unit according to the second embodiment.
Figure 12B:
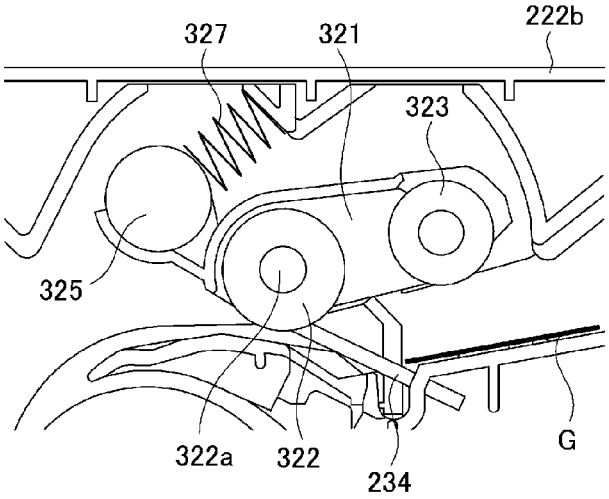
Figure 13:
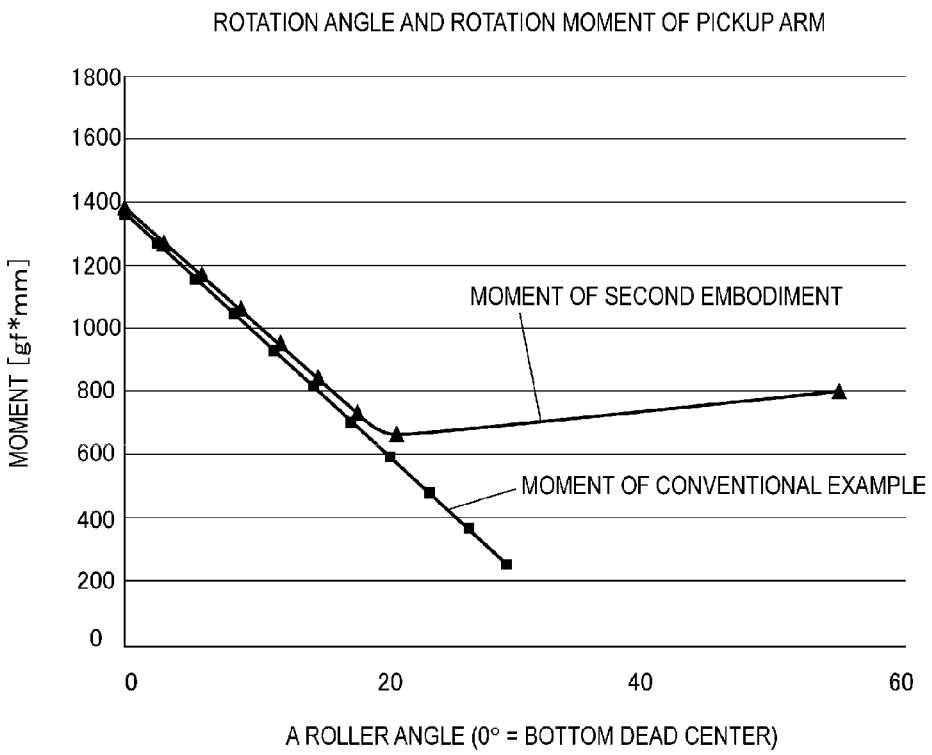
FIG. 13 is a view illustrating a relationship between a rotation angle and a moment of a pickup arm.

As illustrated in FIG. 12A, the pickup arm 321 is located at the retracted position so as to receive the original G up to a position where the front edge of the original G collides with the original stopper 223*a*. In this case, the pickup arm 321 waits at the retracted position by the weight of the weight member 325. In this case, when the original G is set, the entry of the original G into the original feeding path 230 is restricted at the original feeding position by the original stopper 223*a*, and the presence or absence of the original G is detected by the original detection sensor 223*b*.

Next, when the user instructs to start reading the original G from an operation portion (not illustrated), the driving motor M2 is driven and the pickup arm 321 starts rotating around the separation shaft 322*a* against the weight member 325 in a clockwise direction in FIG. 12A. When the pickup arm 321 is rotated by a predetermined amount, as illustrated in FIG. 12B, the weight member 325 abuts against the biasing spring 327.

Figure 12C:
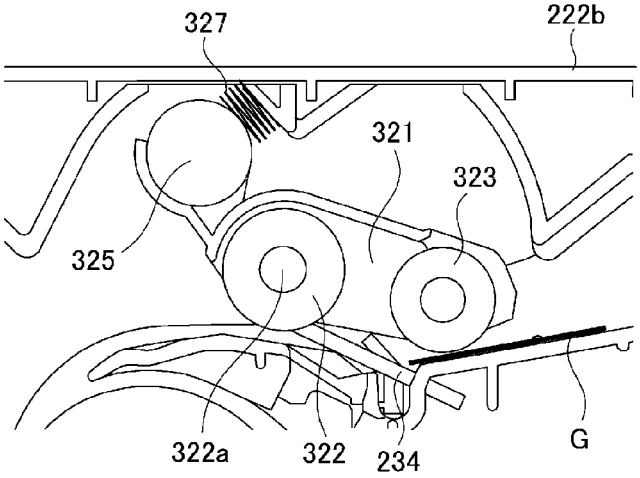

When the pickup arm 321 is rotated again in a clockwise direction, the pickup roller 323 is moved toward the feeding position illustrated in FIG. 12C, and the pickup roller 323 abuts against the top original G stacked in the original stack tray 223. When the pickup roller 323 abuts against the top original G, the pickup arm 321 receives a predetermined reaction force from the original G with respect to the lowering direction and the spring clutch 326 starts idling. Therefore, the lowering of the pickup arm 321 is stopped in a state in which the pickup roller 323 abuts against the original G, and the feeding of the original G is started by the pickup roller 323. In this case, the biasing spring 327 is pressed by the weight member 325 and thus is compressed.

The original G fed by the pickup roller 323 is separated one by one by the separation roller 322 and the separation pad 234, and only the top original G is fed to the original feeding path 230. The original G fed to the original feeding path 230 is conveyed toward the image reading position by the pair of original conveying rollers 227. When the edge sensor 227*a* detects the front edge of the original G, image information of a first surface (front surface) of the original G starts to be read by the scanner unit 211 at a position conveyed by a predetermined amount from the detected position. Also, at the position conveyed by the predetermined amount from the detection position, the pendulum gear 331 is separated from the separation driving gear 311 by reversely rotating the driving motor M2 and the driving transmission is blocked.

When the driving transmission of the driving motor M2 and the separation driving gear 311 is blocked, the torque transmitted in the lowering direction of the pickup arm 321 is eliminated. Therefore, the pickup arm 321 starts to be rotated (lifted) toward the retracted position illustrated in FIG. 12A by the moment around the separation shaft 322*a* caused by the self-weight of the weight member 325 and the biasing force of the biasing spring 327. When the pickup arm 321 is lifted, the pickup roller 323 is separated from the original G and the feeding of the original G is stopped. Since the subsequent operations are substantially the same as those of the first embodiment, a description thereof will be omitted.

As described above, the printer according to the second embodiment assists the initial motion when the pickup arm 321 is moved to the retracted position by the biasing force of the biasing spring 327. Therefore, as illustrated in FIG. 13, the moment of the initial motion from the feeding position of the pickup arm 321 can be appropriately secured. Therefore, for example, it is possible to prevent the weight member 325 from being larger than required so as to secure the moment of the initial motion. As a result, when moved to the retracted position, the pickup arm 321 is bounded and it is possible to prevent the conveying force from being varied.

Also, since the weight member 325 need not be disposed at a position spaced apart from the separation shaft 322*a* being the rotation center so as to ensure the moment of the initial motion, it is possible to prevent the apparatus from becoming large.

Although the embodiments of the present invention have been described, the present invention is not limited to the embodiments described above. Also, the effects described in the embodiments of the present invention are merely the enumeration of the most suitable effects occurring in the present invention. The effects of the present invention are not limited to those described in the embodiments of the present invention.

For example, in the present embodiment, the printer of the electrophotographic system has been described, but the present invention is not limited thereto. For example, the present invention can also be applied to an inkjet printer (image forming apparatus) which forms an image by ejecting an ink fluid from a nozzle on a sheet.

Also, in the present embodiment, the configuration in which the separating/feeding unit 300 as the sheet feeding apparatus is used in the automatic feeding apparatus has been described, but the present invention is not limited thereto. For example, the separating/feeding unit 300 may be used in the sheet feeding portion 30 of the printer body 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-201297, filed Sep. 27, 2013, which is hereby incorporated by reference herein in its entirety.

What is claimed is:

1. A sheet feeding apparatus comprising:

a sheet stacking portion in which a sheet is stacked;

a feeding roller which feeds the sheet stacked in the sheet stacking portion;

a pickup arm which supports the feeding roller such that the feeding roller is movable between a feeding position abutting against the sheet stacked in the sheet stacking portion and a retracted position spaced apart from the feeding position;

a driving rotational shaft which is connected to the feeding roller and rotates the pickup arm;

a driving portion which drives the driving rotational shaft;

a weight member which is supported to the pickup arm on a side opposite to the feeding roller with respect to the driving rotational shaft; and a biasing member which abuts against the weight member or the pickup arm in a state in which the feeding roller is moved to the feeding position, wherein when the driving rotational shaft is driven by the driving portion, the pickup arm is rotated and the feeding roller feeds the sheet at the feeding position, wherein when a driving from the driving portion to the driving rotational shaft is stopped, the pickup arm is rotated by the weight member and the feeding roller is moved to the retracted position, and wherein when transmission of a driving from the driving portion to the driving rotational shaft is stopped, the weight member is biased by the biasing member to rotate the pickup arm, and the feeding roller is moved to the retracted position.

2. The sheet feeding apparatus according to claim 1, further comprising a driving transmission unit which, when a predetermined torque is applied to the pickup arm, blocks transmission of a driving from the driving rotational shaft.

3. The sheet feeding apparatus according to claim 2, wherein the driving transmission unit is a spring clutch.

4. The sheet feeding apparatus according to claim 1, wherein the biasing member is spaced apart from the weight member at the retracted position.

5. The sheet feeding apparatus according to claim 1, further comprising:

a separation roller which is fixed to the driving rotational shaft; and a separation pad against which the separation roller is pressed, wherein the sheet fed by the feeding roller is separated one by one at a nip between the separation roller and the separation pad.

6. An image reading apparatus comprising:

an image reading portion which reads an image of a sheet; and a sheet feeding apparatus which feeds the sheet to a predetermined image reading position with respect to the image reading portion, the sheet feeding apparatus including:

(a) a sheet stacking portion in which a sheet is stacked;

(b) a feeding roller which feeds the sheet stacked in the sheet stacking portion;

(c) a pickup arm which supports the feeding roller such that the feeding roller is movable between a feeding position abutting against the sheet stacked in the sheet stacking portion and a retracted position spaced apart from the feeding position;

(d) a driving rotational shaft which is connected to the feeding roller and rotates the pickup arm;

(e) a driving portion which drives the driving rotational shaft;

(f) a weight member which is supported to the pickup arm on a side opposite to the feeding roller with respect to the driving rotational shaft; and (g) a biasing member which abuts against the weight member or the pickup arm in a state in which the feeding roller is moved to the feeding position, wherein when the driving rotational shaft is driven by the driving portion, the pickup arm is rotated and the feeding roller feeds the sheet at the feeding position, wherein when a driving from the driving portion to the driving rotational shaft is stopped, the pickup arm is rotated by the weight member and the feeding roller is moved to the retracted position, and wherein when transmission of a driving from the driving portion to the driving rotational shaft is stopped, the weight member is biased by the biasing member to rotate the pickup arm, and the feeding roller is moved to the retracted position.

7. The image reading apparatus according to claim 6, further comprising a driving transmission unit which, when a predetermined torque is applied to the pickup arm, blocks transmission of a driving from the driving rotational shaft.

8. The image reading apparatus according to claim 7, wherein the driving transmission unit is a spring clutch.

9. The image reading apparatus according to claim 6, wherein the biasing member is spaced apart from the weight member at the retracted position.

10. The image reading apparatus according to claim 6, further comprising:

a separation roller which is fixed to the driving rotational shaft; and a separation pad against which the separation roller is pressed, wherein the sheet fed by the feeding roller is separated one by one at a nip between the separation roller and the separation pad.

11. An image forming apparatus comprising:

an image reading portion which reads an image of a sheet;

an image forming portion which is capable of forming the image read by the image reading portion on a sheet; and a sheet feeding apparatus which feeds the sheet to a predetermined image reading position with respect to the image reading portion, the sheet feeding apparatus including:

(a) a sheet stacking portion in which a sheet is stacked;

(b) a feeding roller which feeds the sheet stacked in the sheet stacking portion;

(c) a pickup arm which supports the feeding roller such that the feeding roller is movable between a feeding position abutting against the sheet stacked in the sheet stacking portion and a retracted position spaced apart from the feeding position;

(d) a driving rotational shaft which is connected to the feeding roller and rotates the pickup arm;

(e) a driving portion which drives the driving rotational shaft;

(f) weight member which is supported to the pickup arm on a side opposite to the feeding roller with respect to the driving rotational shaft; and (g) a biasing member which abuts against the weight member or the pickup arm in a state in which the feeding roller is moved to the feeding position, wherein when the driving rotational shaft is driven by the driving portion, the pickup arm is rotated and the feeding roller feeds the sheet at the feeding position, wherein when a driving from the driving portion to the driving rotational shaft is stopped, the pickup arm is rotated by the weight member and the feeding roller is moved to the retracted position, and when transmission of a driving from the driving portion to the driving rotational shaft is stopped, the weight member is biased by the biasing member to rotate the pickup arm, and the feeding roller is moved to the retracted position.

12. The image forming apparatus according to claim 11, further comprising a driving transmission unit which, when a predetermined torque is applied to the pickup arm, blocks transmission of a driving from the driving rotational shaft.

13. The image forming apparatus according to claim 12, wherein the driving transmission unit is a spring clutch.

14. The image forming apparatus according to claim 11, wherein the biasing member is spaced apart from the weight member at the retracted position.

15. The image forming apparatus according to claim 11, further comprising:

a separation roller which is fixed to the driving rotational shaft; and a separation pad against which the separation roller is pressed, wherein the sheet fed by the feeding roller is separated one by one at a nip between the separation roller and the separation pad.

* * * * *